United States Patent [19]
Mitsuishi et al.
[11] 4,196,667
[45] Apr. 8, 1980

[54] PRINT HAMMER FOR LINE PRINTER

[75] Inventors: Akio Mitsuishi; Hiroyuki Akazawa; Kozo Ishizaka, all of Shiojiri, Japan; Shinshu Seiki Kabushiki Kaisha, 03, Nagano, both of Japan

[73] Assignee: Kabushiki Kaisha Suwa Seikosha, Tokyo

[21] Appl. No.: 889,475

[22] Filed: Mar. 23, 1978

[30] Foreign Application Priority Data

Mar. 23, 1977 [JP] Japan ..... 52/31763

[51] Int. Cl.[2] ..... B41J 9/00; B41J 1/20

[52] U.S. Cl. ..... 101/93.48; 101/93.14; 400/144.3

[58] Field of Search ..... 101/93.14, 111, 93.48; 400/143, 144, 144.1, 144.2, 144.3

[56] References Cited

U.S. PATENT DOCUMENTS

| | | | |
|---|---|---|---|
| 3,416,442 | 12/1968 | Brown | 101/93.14 |
| 3,640,217 | 2/1972 | Drejza | 101/93 C |
| 3,653,321 | 4/1972 | Cunningham | 101/93.14 |
| 3,698,529 | 10/1972 | Cattaneo | 400/144.3 |
| 3,734,013 | 5/1973 | Belser | 101/93.14 |
| 3,893,390 | 7/1975 | Deproux | 101/111 |
| 3,901,371 | 8/1975 | Scott | 400/157.2 |
| 3,907,091 | 9/1975 | Meier | 400/144.3 |

FOREIGN PATENT DOCUMENTS

| | | | |
|---|---|---|---|
| 2063830 | 7/1971 | Fed. Rep. of Germany | 101/93.48 |

*Primary Examiner*—Clyde I. Coughenour
*Attorney, Agent, or Firm*—Blum, Kaplan, Friedman, Silberman & Beran

[57] ABSTRACT

A print hammer having an improved head portion for striking a selected moving print character member in a line printing device is provided. The printing device prints when the print hammer strikes a print character member at a predetermined print position forcing the character member against an ink ribbon, a print paper and a platen. The head portion is formed with an inclined surface facing the direction of approaching adjacent character members to drive an adjacent character member striking the side of the print hammer around the print hammer for avoiding jamming and damage to character members and print hammers. In a preferred embodiment the head portion is substantially "V" shaped with the apex of the V disposed in a direction opposite to the movement of the print character members.

1 Claim, 6 Drawing Figures

PRINT HAMMER FOR LINE PRINTER

BACKGROUND OF THE INVENTION

This invention relates generally to a print hammer for use in a line printing device, and particularly to the head portion of the print hammer for striking the print character member. In conventional line printing devices having a plurality of print hammers for selectively striking a print character member of a plurality of moving print character members, printing is accomplished by the impact of a print hammer on the back side of the selected print character member for forcing the character member into an ink ribbon, paper and platen. In order to avoid shadow printing caused by deflection of adjacent character members striking the print hammer, pivotally mounted print hammers have been provided with inclined cam surfaces on a guide arm for contacting a projecting guide surface on the type carrier prior to printing for laterally adjusting the print position of the print hammer. Such a guide surface arrangement is unsuitable for use with an elongated print hammer not capable of lateral displacement. Accordingly, it is desirable to provide an improved elongated print hammer of simplified construction which would avoid the possibility of damage to the head of the print hammer or an adjacent print character member which may strike the print hammer.

SUMMARY OF THE INVENTION

Generally speaking, in accordance with the invention, an improved print hammer for use in a line printing device including a plurality of print hammers and a plurality of print character members is provided. The device prints when a print hammer strikes a selected print character member of a plurality of print character members moving transversely across a print paper. When the print hammer is selectively actuated, it is displaced in a print direction towards the print paper striking a print character member into an ink ribbon against the print paper which is wound about a platen. The improved print hammer is an elongated member formed with guide surfaces for guiding travel in the print direction parallel to its longer dimension for striking the print character member and return travel for returning the print hammer to its at rest position. The head of the print hammer is formed with a flat end surface for striking the back of a print character member and an inclined side edge on the side of the print hammer facing the approaching print character members. In a preferred embodiment of the invention the print hammer head portion is formed with a substantially "V" shaped bend with the apex of the "V" facing the approaching print character members.

Accordingly, it is an object of the invention to provide an improved print hammer for use in a line printing device.

Another object of the invention is to provide an improved print hammer for a line printing device wherein the head of the print hammer is formed with an inclined surface facing approaching print character members.

A further object of the invention is to provide an improved print hammer for a line printing device wherein the head of the print hammer is formed in a "V" shaped bend for displacing an adjacent character member striking the print hammer.

Still another object of the invention is to provide an improved print hammer for a line printing device wherein the head of the print hammer is formed into a "V" by press-bending.

Another object of the invention is to provide an improved print hammer for use in a line printing device which avoids damage to the print hammer and character members.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
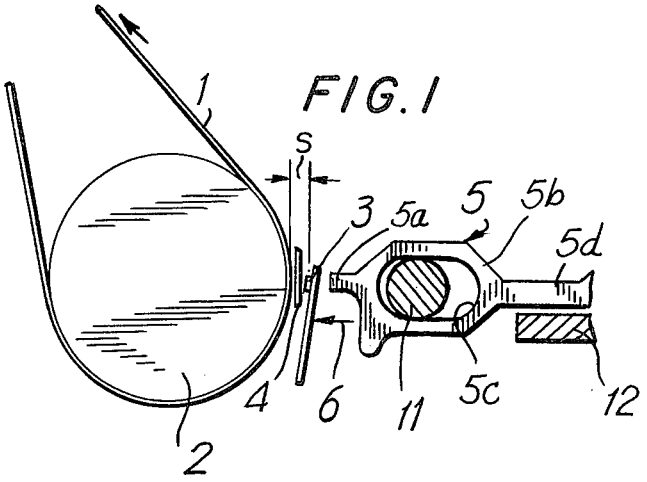
FIG. 1 is a schematic view in elevation showing a print hammer and associated print elements of a line printing device.

FIG. 1 shows schematically a side elevational view of the printing elements of a line printing device including a paper 1 wound about a platen 2, an ink ribbon 4 passing between paper 1 and a print character member 3 maintained a distance S from paper 1. An elongated print hammer 5 is formed with a head portion 5*a* for striking print character member 3 and a body portion 5*b* formed with an opening 5*c* for mounting print hammer 5 on a circular guide rail 11 fixed to the printer frame (not shown). Print hammer 5 includes a tail portion 5*d* for slideably engaging a flat guide rail 12 also fixed to the printer frame. When print hammer 5 is actuated for printing by a print control means (not shown) hammer 5 is displaced in a print direction towards platen 2 as indicated by an arrow 6 thereby striking print character 3 against ink ribbon 4, paper 1 and platen 2.

Figure 2:
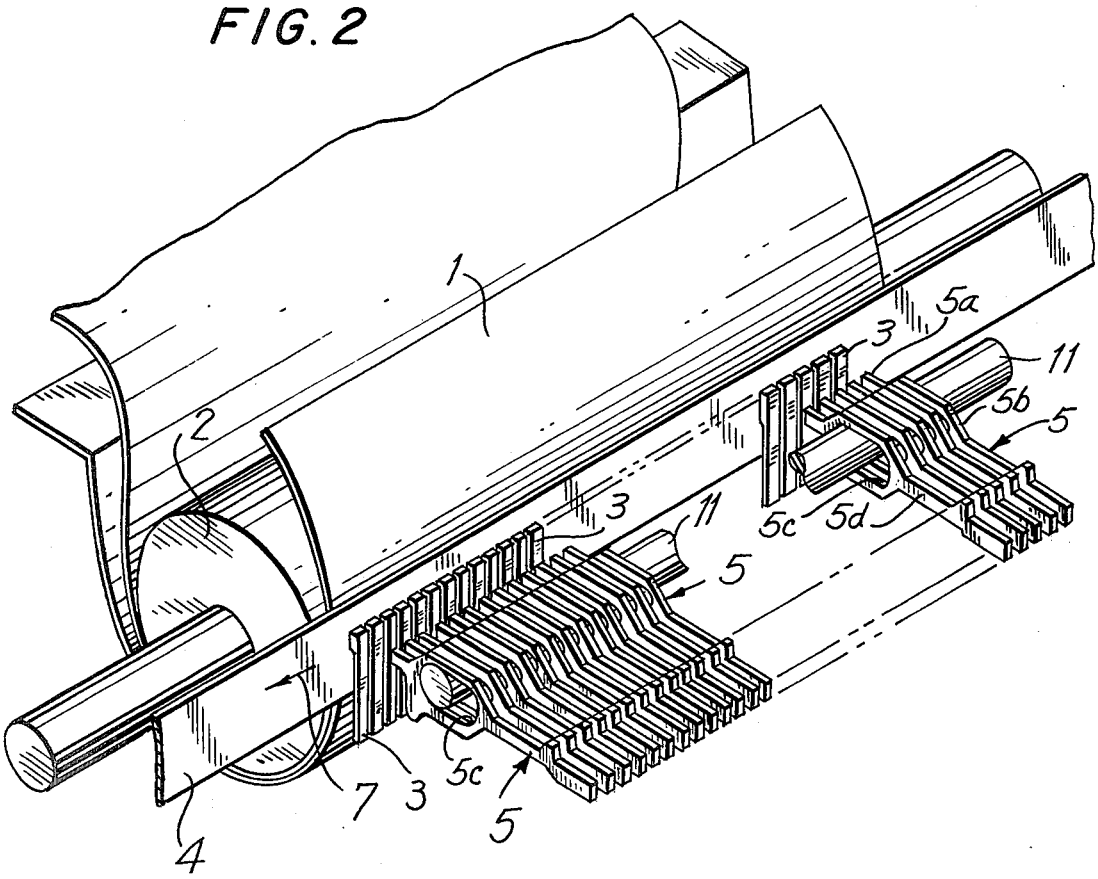
FIG. 2 is a perspective view of a line printing device illustrating a plurality of print elements shown in FIG. 1.

Referring now to FIG. 2, a plurality of print character members 3 and a series of print hammers 5 are shown in the perspective view. Print characters 3 are mounted on an endless belt (not shown) and are continuously moved transversely across paper 1 between paper 1 and print hammers 5 in a direction indicated by an arrow 7. A selected print hammer 5 is disposed behind a selected print character member 3 corresponds to the character to be printed. Just before print character member 3 is in position to be printed, print hammer 5 is actuated by the printing control means and print hammer 5 flies in arrow direction 6 as shown in FIG. 1, striking print character member 3 against ink ribbon 4, and paper 1 and platen 2.

Figure 3:
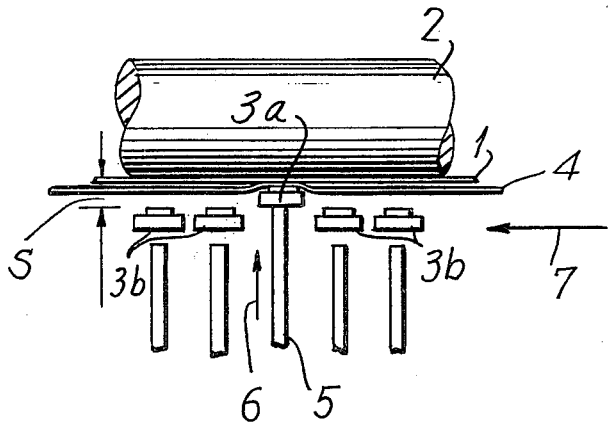
FIG. 3 is a schematic top plan view illustrating the position of printing elements at the moment of printing.

In FIG. 3 print hammer 5 is shown after it has been displaced in arrow direction 6 distance S for printing. In this illustration a selected print character 3*a* has been displaced distance S and is shown pressing ink ribbon 4 against paper 1 and platen 2. When the line printing device functions as shown in FIG. 3, the adjacent print character members 3*b* remain in their at rest position a distance S from platen 2. When print character members 3*b* are maintained in this at rest position, print paper 1 does not become dirty due to shadow printing caused by adjacent print character members 3*b* being driven into print paper 1. Print character members 3*b* remain in their at rest positions a distance S from print paper 1 and printing of excellent quality can be obtained. However, when the return speed of print hammer 5 after printing print character member 3*a* is slow or if the printing speed of print hammer 5 and print character members 3 are out of phase, the condition shown in FIG. 4 occurs.

Figure 4:
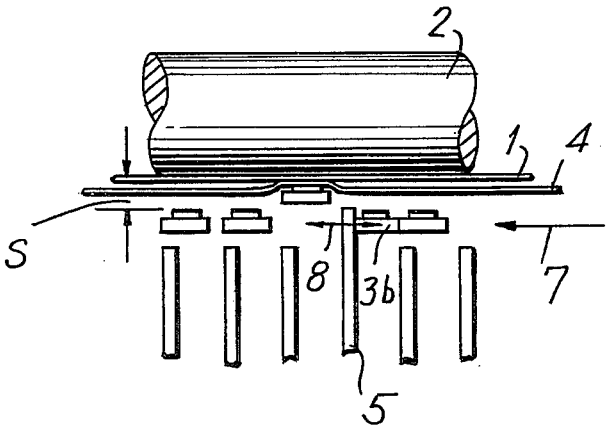
FIG. 4 is a schematic top plan view illustrating a print hammer interfering with an adjacent print character member.

In the condition illustrated in FIG. 4, print hammer 5 interferes with adjacent print character member 3*b* after printing print character member 3*a* as print character member 3*b* approaches print hammer 5 in the direction of the moving print character members as indicated by an arrow 7. When this interference occurs an abnormal force is imposed between print character member 3*b* and print hammer 5 in a direction indicated by an arrow 8. There exists the possibility that print character member 3*b* or print hammer 5 may be broken. This condition can be avoided by constructing a print hammer in accordance with the invention.

Figure 5:
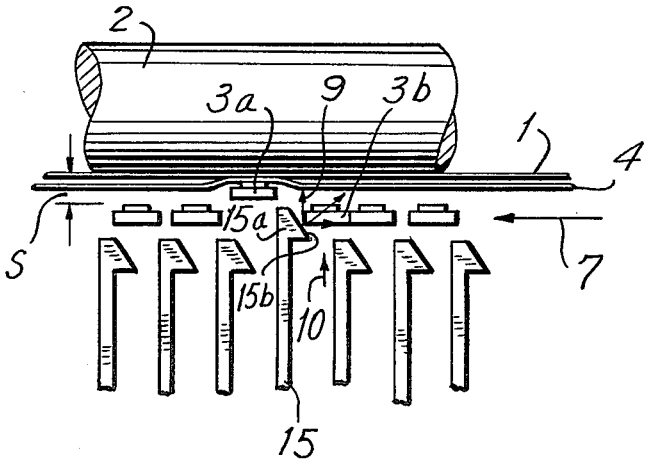
FIG. 5 is a schematic top plan view illustrating a print hammer in accordance with the invention interfering with an adjacent print character member.

Referring now to FIG. 5, a print hammer 15 having a head portion 15*a* constructed and arranged in accordance with the invention is shown. Like elements of FIGS. 1–4 in FIG. 5 are represented by like reference numerals. Print hammer 15 is formed with a head portion 15*a* having an inclined side surface 15*b* on the side of print hammer 15 facing approaching print character members 3*b*. As print character member 3*b* interferes with print hammer 15, print character member 3*b* is moved in a direction indicated by an arrow 9 due to the impact and print character member 3*b* is moved in a direction substantially normal to the direction of movement of print character members 3 as indicated by an arrow 10, namely around head portion 15*a* without contacting print paper 1. Thus, print character member 3*b* is not deflected in the direction of arrow 8 shown in FIG. 4 and breaking of a print character member can be avoided. When print character members 3 are in phase with striking print hammers 5 in a normal printing condition, print hammer 15 and head 15*a* do not interfere with adjacent print character members 3*b* and the normal cycle is performed.

Figure 6:
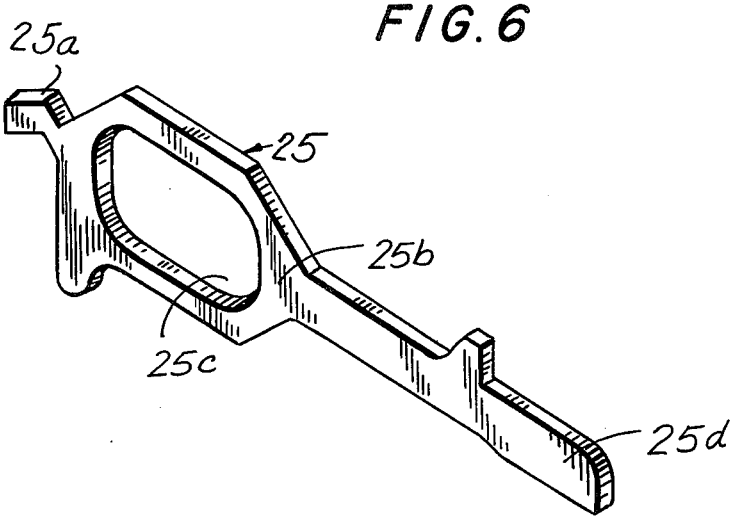
FIG. 6 is a perspective view of a print hammer constructed and arranged in accordance with the invention for use in a line printing device of the type illustrated in FIG. 2.

Referring now to FIG. 6, a print hammer shown generally as 25 constructed and arranged in accordance with a preferred embodiment of the invention is shown. Print hammer 25 is formed with a head portion 25*a* for striking print character members 3 during printing and an elongated body portion 25*b* for guiding displacement during printing including an opening 25*c* and a tail portion 25*d*. Head portion 25*a* is formed with a substantially flat front for striking print character members 3 and a "V" shaped bend extending to the extremity of print hammer 25 with the apex of the "V" in a direction opposite to the displacement of moving print character members 3. The forward inclined surface of "V" shaped head portion 25*a* enables deflection of an approaching adjacent print character member striking the side of print hammer 25 about head portion 25*a* without causing damage to either print hammer 25 or print character member 3*b*.

The advantages of print hammer 25 having head portion 25*a* constructed in this manner include the facts that the V-shaped head portion 25*a* may be formed from flat sheet material in a single operation by bending with a press. Thus, the cost of an improved print hammer constructed and arranged in accordance with this embodiment of the invention is not increased substantially over a conventional flat headed elongated print hammer. The defects existing with conventional flat headed print hammers can be avoided at little incremental cost by forming head portion 25*a* by bending with a press. Thus, a significant advantage in operating efficiency and avoidance of damage to print character members may be obtained at low cost.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An elongated print hammer for use in a line printing device, said line printing device including a plurality of print character members moving transversely across a paper wound about a platen wherein printing is accomplished by the print hammer being displaced between a first at rest position and a second print position along the direction of the longer dimension of said print hammer for striking a selected print character member in a direction substantially normal to the direction of movement of the print character members thereby driving the selected print character member into a print position on the paper and platen, comprising an elongated single piece essentially uniform thickness plate with a head portion pressed and bent to form a V-shape with the apex of the V on the side of the print hammer facing the approaching print character members for engaging said print character members, the V-shaped head portion adapted to displace said selected one of said print character members without causing an adjacent print character member to print on said paper prior to said print hammer returning to the first at rest position.

* * * * *